US005759136A

United States Patent [19]

Chen

[11] Patent Number: 5,759,136

[45] Date of Patent: Jun. 2, 1998

[54] EXERCISER HAVING MOVABLE FOOT SUPPORTS

[76] Inventor: Paul Chen, 5F., No. 31, Gan Tzou 2nd St., Shi Tun Chu, Taichung, Taiwan

[21] Appl. No.: 895,963

[22] Filed: Jul. 17, 1997

[51] Int. Cl.[6] ..... A63B 22/00; A63B 69/16

[52] U.S. Cl. ..... 482/57; 482/70

[58] Field of Search ..... 482/51, 52, 53, 482/57, 70, 79, 80, 71, 62, 60, 148

[56] References Cited

U.S. PATENT DOCUMENTS

| | | | |
|---|---|---|---|
| 5,352,169 | 10/1994 | Eschenbach | 482/57 |
| 5,383,829 | 1/1995 | Miller | 482/57 |
| 5,423,729 | 6/1995 | Eschenbeck | 482/70 |
| 5,518,473 | 5/1996 | Miller | 482/57 |
| 5,562,574 | 10/1996 | Miller | 482/51 |
| 5,577,985 | 11/1996 | Miller | 482/52 |
| 5,685,804 | 11/1997 | Whan-Tong | 482/51 |

*Primary Examiner*—Stephen B. Crow

[57] ABSTRACT

An exerciser includes a pair of levers and a pair of cranks pivotally secured on a base and a pair of beams secured between the levers and the cranks for allowing the beams to move along a circular path. A pair of foot supports are slidably engaged on the beams and are moved along the beams for allowing the foot supports to move along an elliptic path. Two further cranks are secured to the cranks and are pivotally coupled to the foot supports by a pair of links for allowing the links to move the foot supports along the beams.

6 Claims, 3 Drawing Sheets

EXERCISER HAVING MOVABLE FOOT SUPPORTS

BACKGROUND OF THE INVENTION

1. Field of the Invention

The present invention relates to an exerciser, and more particularly to a stationary exerciser.

2. Description of the Prior Art

Typical stationary exercisers comprise a pair of foot pedals each having one or more wheels rotatably or slidably engaged with one or more tracks for allowing the foot pedals to move both upward and downward and forward and backward movements. U.S. Pat. No. 5,352,169 to Eschenbach and U.S. Pat. No. 5,383,829 to Miller disclose this type of stationary exercisers. However, the wheels may be disengaged from the tracks and may hurt the children inadvertently.

The present invention has arisen to mitigate and/or obviate the afore-described disadvantages of the conventional exercisers.

SUMMARY OF THE INVENTION

The primary objective of the present invention is to provide a stationary exerciser including a pair of foot supports that may be moved along a movable beams for allowing the user to conduct a stepping exercise along an elliptical moving path.

In accordance with one aspect of the invention, there is provided an exerciser comprising a base including a rear axle and a front axle, a pair of levers including an upper portion pivotally coupled to the front axle for allowing the levers to be rotated about the rear axle, a pair of first cranks rotatably secured to the rear axle and adapted to be rotated about the rear axle, a pair of beams including a front portion pivotally secured to the levers and including a rear portion pivotally coupled to the first cranks, a pair of foot supports slidably engaged on the beams respectively, and means for moving the foot supports along the beams.

The moving means includes a pair of second cranks secured to the first cranks, and a pair of links pivotally secured the foot supports to the second cranks for allowing the links to move the foot supports along the beams.

The second cranks each includes an arm having a first end secured to the first crank and having a second end, the links each includes a first end pivotally secured to the foot supports and each includes a second end pivotally secured to the second end of the arm at a pivot shaft.

The arms each includes at least two holes, the pivot shafts are adapted to be secured to either of the holes for adjusting a distance between the pivot shaft and the first crank and for adjusting a moving stroke of the foot supports relative to the beams respectively.

The first cranks include a pair of wheels rotatably secured to the rear axle and include a pair of pivot poles secured to the wheels and spaced from the rear axle, the pivot poles are arranged opposite from each other for forming the first cranks. The base includes a front portion having a post extended upward for supporting a handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
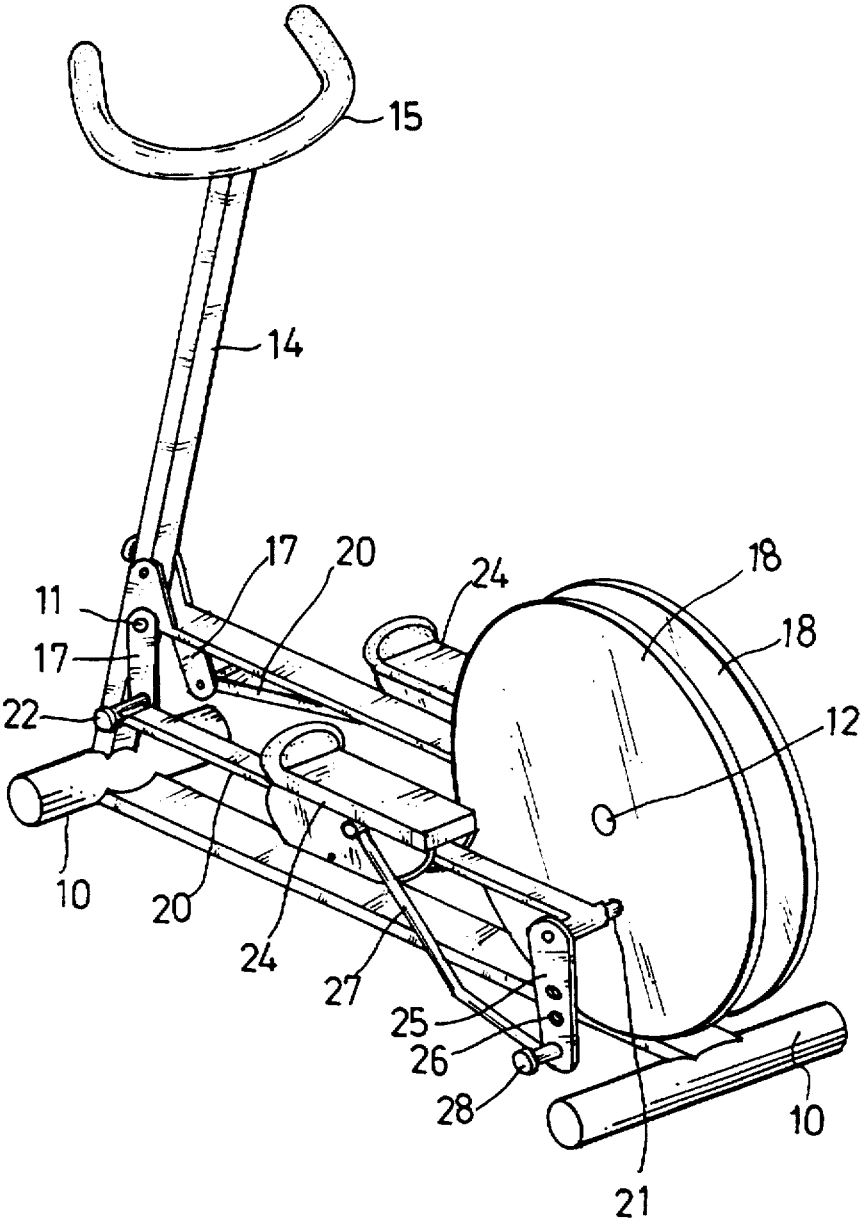
FIG. 1 is a perspective view of a stationary exerciser in accordance with the present invention.
Figure 2:
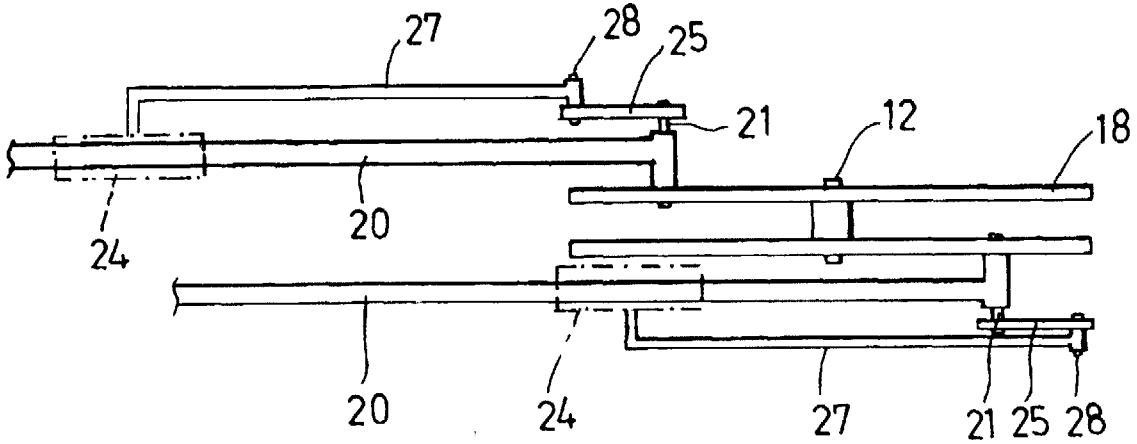
FIG. 2 is a partial top view of the exerciser.
Figure 3:
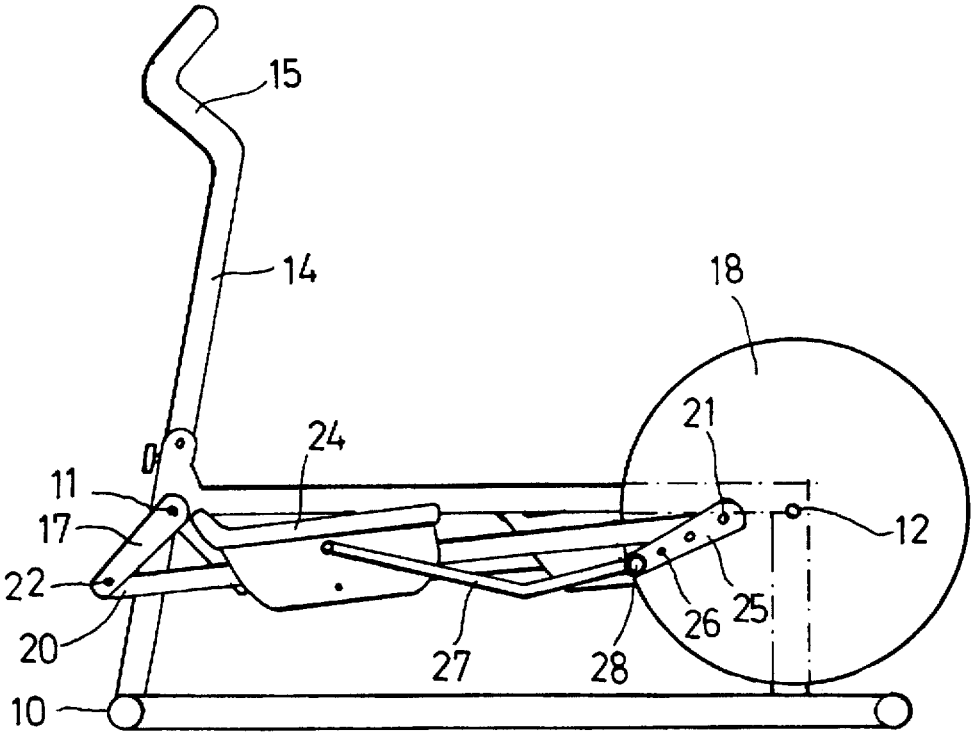
FIGS. 3 and 4 are side views illustrating the operation of the exerciser.

Referring to the drawings, and initially to FIGS. 1–3, a stationary exerciser in accordance with the present invention comprises a base 10 including a front axle 11 and a rear axle 12, and including a post 14 extended upward from the front portion for supporting a handle 15 which may be used for supporting the upper portion of the user. A pair of levers 17 include an upper portion pivotally secured to the front axle 11 for allowing the levers 17 to be rotated about the front axle 11 respectively. A pair of wheels 18 are rotatably secured to the rear axle 12.

A pair of pivot rods 21 are secured to the wheels 18 and formed as a pair of cranks 21 (FIG. 2) for allowing the cranks 21 to be rotated in concert with the wheels 18 and to be rotated about the rear axle 12. A pair of beams 20 include a front portion pivotally secured to the bottom portions of the levers 17 by pivot pins 22 and include a rear portion pivotally secured to the cranks 21 for allowing the beams 20 to be moved along a substantially circular path. The distance between the crank 21 and the rear axle 12 may determine the moving stroke of the beams 20; i.e., when the crank 21 is moved and secured to the radially outward portion relative to the rear axle 12, the moving stroke of the beams 20 may be increased.

A pair of foot supports 24 are slidably engaged on the beams 20. Two arms 25 are secured to the cranks 21 and each includes one or more holes 26 for engaging with a pivot shaft 28. A pair of links 27 each has one end pivotally secured to the foot supports 24 and each has the other end pivotally secured to the pivot shafts 28 for allowing the other end of the links 27 to be rotated about the pivot shafts 28 respectively and relatively. The arms 25 and the pivot shafts 28 form another pair of cranks and may rotate about the pivot rods 21 such that the foot supports 24 may be moved in a reciprocating action along the beams 20 by the links 27 and the cranks formed by the arms 25 and the pivot shafts 28. The pivot shafts 28 may be adjusted and secured to different holes 26 for adjusting the moving stroke of the foot supports 24.

Figure 4:
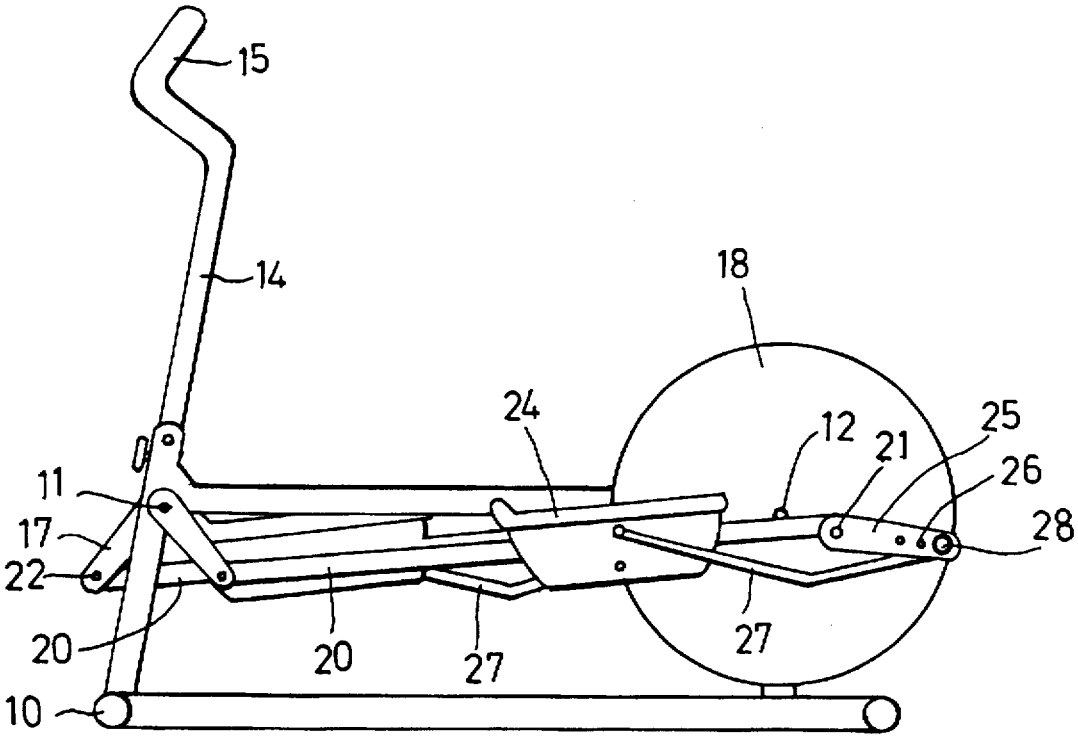

In operation, as shown in FIGS. 3 and 4, the rear ends of the beams 20 and the pivot rods 21 may be rotated about the rear axle 12 such that the beams 20 may be moved along a substantially circular path. The cranks 25, 28 may further move the foot supports 24 along the beams 20 for further forming another moving path for the foot supports 24. The moving strokes of the foot supports 24 may be adjusted by the pivot shafts 28.

Accordingly, the exerciser in accordance with the present invention includes a pair of foot supports that may be moved relative to the support beams for allowing the user to conduct a stepping exercise along an elliptical moving path.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a rear axle and a front axle, a pair of levers including an upper portion pivotally coupled to said front axle for allowing said levers to be rotated about said front axle, a pair of first cranks rotatably secured to said rear axle and adapted to be rotated about said rear axle, a pair of beams including a front portion pivotally secured to said levers and including a rear portion pivotally coupled to said first cranks, a pair of foot supports slidably engaged on said beams respectively, and means for moving said foot supports along said beams.

2. An exerciser according to claim 1, wherein said moving means includes a pair of second cranks secured to said first cranks, and a pair of links pivotally secured said foot supports to said second cranks for allowing said links to move said foot supports along said beams.

3. An exerciser according to claim 2, wherein said second cranks each includes an arm having a first end secured to said first crank and having a second end, said links each includes a first end pivotally secured to said foot supports and each includes a second end pivotally secured to said second end of said arm at a pivot shaft.

4. An exerciser according to claim 3, wherein said arms each includes at least two holes, said pivot shafts are adapted to be secured to either of said holes for adjusting a distance between said pivot shaft and said first crank and for adjusting a moving stroke of said foot supports relative to said beams respectively.

5. An exerciser according to claim 1, wherein said first cranks include a pair of wheels rotatably secured to said rear axle and include a pair of pivot poles secured to said wheels and spaced from said rear axle, said pivot poles are arranged opposite from each other for forming said first cranks.

6. An exerciser according to claim 1, wherein said base includes a front portion having a post extended upward for supporting a handle.

* * * * *